US009991648B1

(12) United States Patent
McRae

(10) Patent No.: US 9,991,648 B1
(45) Date of Patent: Jun. 5, 2018

(54) ELECTRICAL PLUG FOR A SAFETY GROUNDED TREE

(71) Applicant: National Tree Company, Cranford, NJ (US)

(72) Inventor: Michael M. McRae, Ormond Beach, FL (US)

( * ) Notice: Subject to any disclaimer, the term of this patent is extended or adjusted under 35 U.S.C. 154(b) by 0 days. days.

(21) Appl. No.: 15/707,802

(22) Filed: Sep. 18, 2017

Related U.S. Application Data

(63) Continuation-in-part of application No. 15/490,880, filed on Apr. 18, 2017, now Pat. No. 9,876,287.

(51) Int. Cl.

| | |
|---|---|
| ***H01R 13/68*** | (2011.01) |
| ***A47G 33/08*** | (2006.01) |
| ***A47G 33/06*** | (2006.01) |
| ***H01R 13/648*** | (2006.01) |
| ***H01R 24/22*** | (2011.01) |
| ***H01R 13/652*** | (2006.01) |
| *H01R 24/30* | (2011.01) |
| *H01R 13/24* | (2006.01) |

(52) U.S. Cl.
CPC ..... *H01R 13/68* (2013.01); *A47G 33/06* (2013.01); *A47G 33/0872* (2013.01); *H01R 13/648* (2013.01); *H01R 13/652* (2013.01); *H01R 24/22* (2013.01); *A47G 2033/0827* (2013.01); *A47G 2200/08* (2013.01); *H01R 13/2442* (2013.01); *H01R 24/30* (2013.01)

(58) Field of Classification Search
CPC ..... H01R 13/68
See application file for complete search history.

(56) References Cited

U.S. PATENT DOCUMENTS

| | | | | |
|---|---|---|---|---|
| 3,829,819 A * | 8/1974 | Eckart | H01R 13/68 | 337/201 |
| 3,833,875 A * | 9/1974 | Holoka | H01H 85/20 | 337/187 |
| RE31,017 E * | 8/1982 | Bernstein | H01R 27/02 | 337/198 |
| 4,579,405 A * | 4/1986 | Hirooka | H01R 9/2491 | 439/106 |
| 4,679,884 A * | 7/1987 | Klemp | H01R 13/68 | 337/198 |

(Continued)

*Primary Examiner* — James Harvey
(74) *Attorney, Agent, or Firm* — James M. Smedley LLC; James Michael Smedley, Esq.

(57) ABSTRACT

An artificial lighted tree is presented with power routed through the trunk of the tree and three-wire safety grounding. The artificial lighted tree comprising a fused electrical plug having improved safety features comprising: a body portion surrounding respective first ends of a first, a second and a third electrical wire, the body portion further comprising a fuse holder embedded within an upper region of the body portion, and a fuse adapted to be releasably secured within the fuse holder via releasable securing means, a live blade in electrical communication with the first end of the first electrical wire, a neutral blade in electrical communication with the first end of the second electrical wire, a ground pin receptacle in electrical communication with the first end of the third electrical wire, wherein the body portion surrounds and maintains the live blade, neutral blade, and ground pin receptacle in spaced apart orientation corresponding to sockets on an electrical outlet.

7 Claims, 7 Drawing Sheets

(56) References Cited

U.S. PATENT DOCUMENTS

| | | | | | |
|---|---|---|---|---|---|
| 5,137,473 | A * | 8/1992 | Nickola | H01R 13/68 | 439/373 |
| 5,236,374 | A * | 8/1993 | Leonard | H01R 31/02 | 439/505 |
| 6,074,252 | A * | 6/2000 | Grieve | H01R 4/2433 | 439/620.32 |
| 7,029,332 | B2 * | 4/2006 | Chien | H01R 13/684 | 439/106 |
| 2005/0128045 | A1 * | 6/2005 | Lin | H01H 85/547 | 337/186 |
| 2007/0254505 | A1 * | 11/2007 | Huang | H01R 31/065 | 439/106 |
| 2010/0210143 | A1 * | 8/2010 | Zhang | H01R 13/68 | 439/620.34 |
| 2015/0194774 | A1 * | 7/2015 | McRae | H01R 24/22 | 439/105 |

* cited by examiner

ELECTRICAL PLUG FOR A SAFETY GROUNDED TREE

CROSS-REFERENCE TO RELATED APPLICATIONS

This application is a continuation-in-part of U.S. Non-Provisional Utility patent application Ser. No. 15/490,880, filed on Apr. 18, 2017 and entitled "An Electrical Plug and Socket Assembly for a Safety Grounded Tree", the entire disclosure of which is hereby incorporated herein by reference.

FIELD OF THE INVENTION

The present invention generally relates to artificial lighted trees and, in particular, to a system including a male power cord having a replaceable fuse for grounding a powered decorative artificial pre-lighted Christmas tree.

BACKGROUND OF THE INVENTION

Artificial pre-lighted Christmas trees, where the seasonal lights are incorporated on or with the tree, have become a popular alternative to both live trees and unlighted artificial trees. These trees are usually sectional for easy storage, with some lighted trees routing power for the lights up through the trunk of the tree with electrical connectors built into the ends of each tree section to distribute power to each section. A concern with such pre-lighted Christmas trees is the use of standard electrical power cords for powering the lights up through the trunk of the tree. The vast majority of electrical power cords generally have an 18 AWG wire cord with a maximum load of 5 amp and 600 watts at 120 volts. Most house wiring is 12 AWG with a 20 amp circuit breaker. At 120 volts, the breaker won't open until 2400 watts are reached. Since this greatly exceeds the appliance cord capability, the cord will overheat and incinerate unless protected by a fuse. The benefits of putting a fuse in an electrical plug have been known for some time. If a fuse is located in the plug of a standard three-wire plug that powers the tree directly, it can provide the protection of a fuse to any seasonal lights that may be incorporated on or with the tree. One potential problem encountered in designing a plug structure for making the fuses readily accessible is that the fuses may become too easily accessible when the conducting prongs of the plug are inserted in a socket. Under such conditions, it is very possible for a user to contact one of the electrical conductors normally abutting the fuse and receive a potentially serious shock.

Therefore, there is a need in the art for a lighted artificial Christmas tree with a fused electrical power cord plug that overcomes the limitations of the prior art by not allowing access to the fuse when the conducting prongs of the plug are inserted in a socket.

SUMMARY OF THE INVENTION

According to one embodiment of the present invention, an apparatus and method are provided for substantially preventing the inadvertent electrical connection of a standard plug to a female socket of an electrical power cord through which electrical power is supplied, for instance, to an artificial lighted tree. The apparatus and method comprise a non-standard female socket used in place of a standard female socket on a three-prong safety grounded electrical power cord that may, for instance, be used to power an artificial lighted tree. The non-standard female socket is configured to include raised side socket walls with vertical half rounds in the respective sidewalls to uniquely mate with a non-standard two-prong non-polarized male electrical plug, customized to include mating grooves cut into the top and bottom lips. Advantageously, use of a non-standard female socket paired with a non-standard two-prong non-polarized male electrical plug functions to prevent electrical connection by standard two-prong non-polarized male electrical plugs thereby permitting use of a three wire cord having a lower amperage rating than a standard UL approved three wire cord.

Another embodiment of the apparatus and method in accordance with the present invention provides a non-standard female socket used in place of a standard female socket on a three-prong safety grounded electrical power cord that may, for instance, be used with an artificial lighted tree. The non-standard female socket is configured to include a single raised side socket wall including a vertical half round in the single raised sidewall to uniquely mate with a non-standard two-prong non-polarized male electrical plug including mating grooves cut into the top and bottom lips. In a further embodiment, the apparatus utilizes a cover to prevent the inadvertent disconnection between the non-standard two-prong non-polarized male electrical plug and non-standard female socket.

According to one embodiment, a non-standard female socket used in place of a standard female socket on a three-prong safety grounded electrical power cord and comprises: (a) a socket body; (b) electrical contact means disposed on the inner socket body for receiving and engaging contact prongs of a non-standard two-prong non-polarized male electrical plug and for providing electrical connections with ends of the conductor wires of an electrical cord; (c) convex vertical half rounds formed in respective raised side walls of the non-standard female socket adapted to mate with a non-standard two-prong non-polarized male electrical plug including mating grooves cut into the top and bottom lips.

According to one embodiment, a non-standard female socket used in place of a standard female socket on a three-prong safety grounded electrical power cord and comprises: (a) a socket body; (b) electrical contact means disposed on the inner socket body for receiving and engaging contact prongs of a non-standard two-prong non-polarized male electrical plug and for providing electrical connections with ends of the conductor wires of an electrical cord; (c) a single convex vertical half round formed in a single raised side wall of the socket; (d) a cover for covering the engagement of the non-standard female socket with the non-standard two-prong non-polarized male electrical plug including mating grooves cut into the top and bottom lips.

According to yet another embodiment of the present invention, an artificial lighted tree is provided with an electrical power cord with improved safety features, the power cord comprising a plug at a first distal end having an internal fuse which can easily and quickly be replaced without disassembly of the plug.

According to another embodiment of the present invention, an electrical power cord having improved safety features comprises a fused electrical plug at a first distal end, the plug comprising: a body portion surrounding respective first ends of a first, a second and a third electrical wire, the body portion further comprising a fuse holder embedded within an upper region of the body portion, and a fuse adapted to be releasably secured within the fuse holder via releasable securing means, a live blade in electrical communication with the first end of the first electrical wire, a neutral blade in electrical communication with the first end of the second electrical wire, a ground pin receptacle in electrical communication with the first end of the third electrical wire, wherein the body portion surrounds and maintains the live blade, neutral blade, and ground pin receptacle in spaced apart orientation corresponding to sockets on an electrical outlet, and a cable coupled to the fused electrical plug, the cable comprising: said first, second and third electrical wires, wherein the first electrical wire is configured to carry current to a load device, the second electrical wire is configured to return current from the load device, and the third electrical wire is configured to carry current to a ground connection. Wherein the fuse is releasably secured within the fuse holder via an access door which maintains it in a closed position when the prongs of the plug have been inserted into a socket rending the internal fuse virtually inaccessible. A compressible latch mechanism attached to the access door maintains the access door in the closed position when the prongs of the plug of the power cord plug are inserted into a wall socket thereby locking the access door in its closed position. The access door may be opened by removing the power cord plug from the wall socket.

According to an embodiment of the present invention, a fused three-prong non-polarized male electrical plug is attached to and provides power and a safety ground connection for a powered decorative lighted Christmas tree. The decorative lighted Christmas tree includes power routed through the trunk of the tree and three-wire safety grounding.

According to embodiments of the present invention, a three-prong safety ground electrical power cord further comprises a foot switch configured to toggle on and off an electrical signal provided to the non-standard female end of the electrical power cord.

According to an embodiment of the present invention, the hot wires of the non-standard three-prong non-polarized male electrical plug enter the trunk of the decorative lighted hollow body Christmas tree through a securing grommet; wherein the ground conductor extends from the electrical power cord and terminates in a ground electrical connector configured to attach to the electrically conductive wall of the hollow body.

The foregoing summary of the present invention with the preferred embodiments should not be construed to limit the scope of the invention. It should be understood and obvious to one skilled in the art that the embodiments of the invention thus described may be further non-standard without departing from the spirit and scope of the invention.

DETAILED SPECIFICATION

Figure 1:
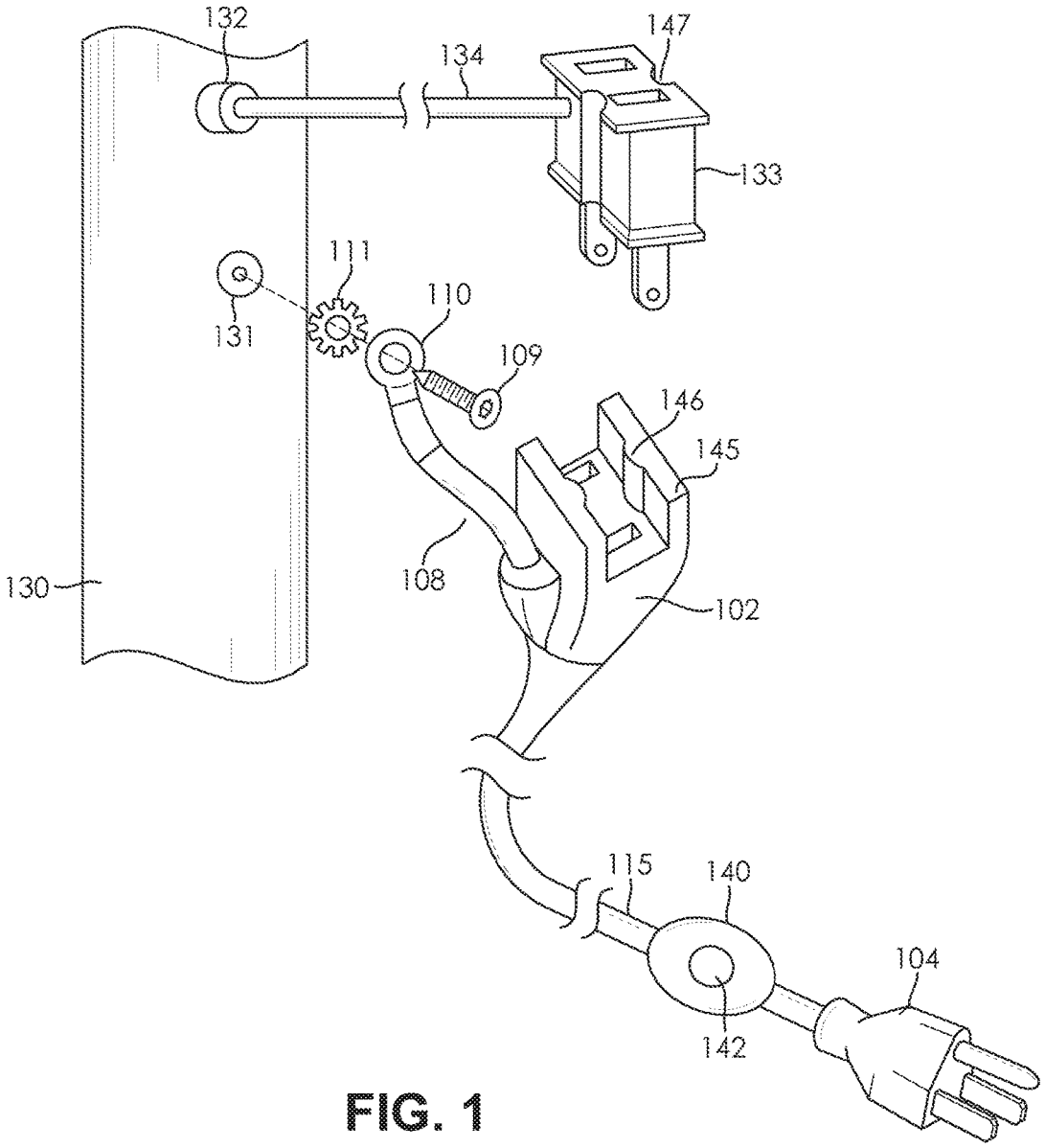
FIG. 1 shows a system for powering a decorative tree including a tree-mounted power cord with a non-standard female end which attaches to the powered decorative tree, according to an embodiment of the present invention.

According to an embodiment of the present invention, FIG. 1 shows a perspective view of a power cord 115 with a conventional 3-prong safety grounded plug 104 on the male end and a non-standard female socket 102 on the female end. The non-standard female socket 102 is shown to include convex vertical half rounds 146 formed in respective raised side walls 145 of the non-standard female socket 102 adapted to mate with a non-standard two-prong non-polarized electrical plug 133 including mating grooves 147 cut into the top and bottom lips. The non-standard female socket 102 of power cord 115 is positioned on a first surface of the female end and also positioned to a second surface of the female end that is non-coplanar to the first surface. The term non-coplanar here can refer to any portion of the female end which is not on the plane defined by the face of the female socket on the first surface. Instead of having a rounded socket to receive a ground prong on the first surface, a ground wire 108 extends out from the second surface of the non-standard female socket and is terminated with a ring terminal 110. This ring terminal 110 is attached to a bare metal ground point 131 on the decorative lighted Christmas tree trunk 130 with a tamper-proof screw 109 and a star washer 111. The power wires 134 of the non-standard two-prong non-polarized male electrical plug 133 enter the trunk of the decorative lighted Christmas tree trunk 130 through a securing grommet 132. Power is distributed within the Christmas tree to various sockets, connectors, and/or light strings on the decorative lighted Christmas tree. An important feature of the power cord 115 depicted in FIG. 1 is that the ground connection (e.g., ground wire 108) can be made independently of the hot and neutral connection of the non-standard two-prong non-polarized male electrical plug 133 without interfering with the ability of the non-standard two-prong non-polarized male electrical plug 133 to be plugged in and removed from the female end 120 of the power cord. One way of achieving this is by placing the ground connection 108 on a surface other than the first surface where the non-standard female socket 120 is placed.

Figure 2A:
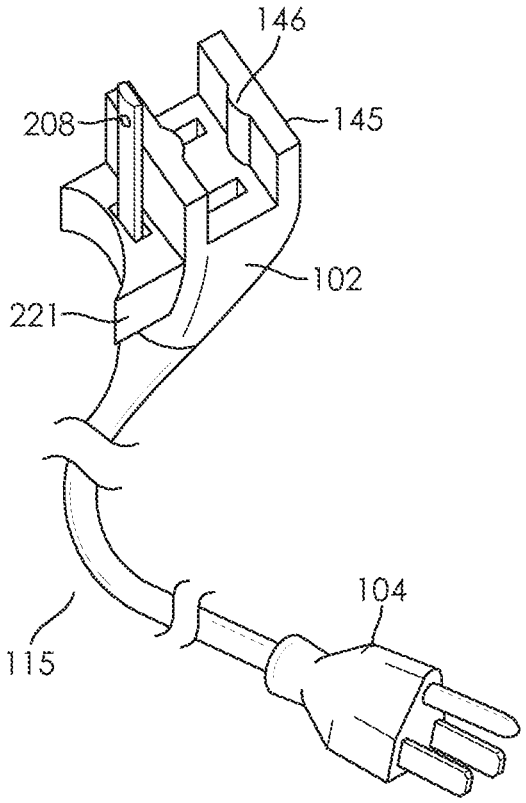
FIG. 2*a* shows a perspective view of a tree-mounted power cord of FIG. 1 with a non-conventional modified female end including half round verticals in raised sidewalls and a ground prong which attaches to a powered decorative tree through a grounding point, according to an embodiment of the present invention.

According to an alternate embodiment of the present invention, FIG. 2*a* shows a different version of the power cord 115 of FIG. 1. In accordance with the present embodiment, the ground wire 108 connection to the trunk 130 shown in the embodiment of FIG. 1 is replaced with a ground prong 208. The ground prong 208 is bent at two 90 degree angles so that it lines up flush with the Christmas tree trunk 130 and the molded base of the non-standard female socket 120. A curved portion 221 of the molded base of the non-standard female socket 102 of the female end is curved to fit the rounded trunk 130 of the decorative lighted Christmas tree.

Figure 2B:
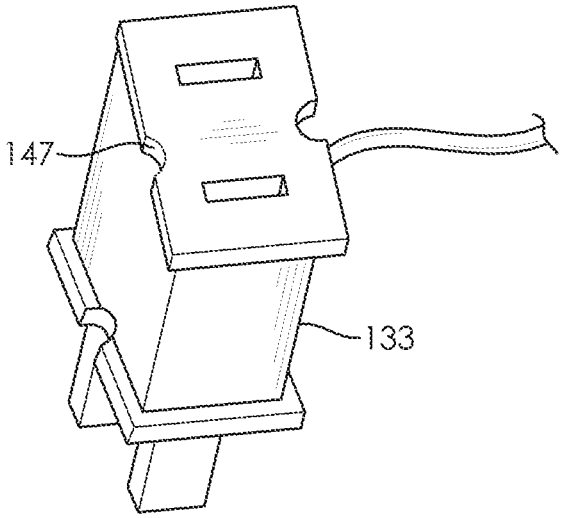
FIG. 2*b* shows a perspective view of a tree mounted non-standard two-prong non-polarized male electrical plug including grooves cut into the top and bottom lip portions of two faces of the plug which attaches to the powered decorative tree of FIG. 1, according to an embodiment of the present invention.

FIG. 2*b* shows a perspective view of the non-standard two-prong non-polarized male electrical plug 133 of FIG. 1. As shown, the non-polarized male electrical plug 133 includes mating grooves 147 cut into the respective top and bottom lips of the non-standard two-prong non-polarized male electrical plug 133 to mate with the non-standard female socket 102 of the power cord 115 as shown in FIGS. 1 and 2*a*.

In a preferred embodiment, in the non-standard two-prong non-polarized male electrical plug 133, both the hot and neutral wires pass through fuses (not shown) because there is no guarantee that the mating plug 133 will be connected in a particular orientation. Alternatively, a single fuse may be placed in the 3-prong safety grounded plug 104, as shown in FIGS. 1 and 2*a*, so that the single fuse is electrically connected in line with the hot wire. In this case, only a single fuse is needed in lieu of the doubly fused male mating plug 133. For safety, the 3-prong safety grounded plug 104 can be configured with a sliding door (not shown) providing access to the fuse. The sliding door only slides open when the grounded male mating plug 133 is not plugged into a female socket 102.

According to an alternate embodiment of the present invention, as illustrated in FIGS. 3-6, a different version of a tree-mounted power cord 115 includes a safety cover 344, shown in exploded view, and a conventional female socket 320 in lieu of the modified non-standard female socket 102 as shown in FIGS. 1 and 2*a*. In the present embodiment, the conventional female socket 320 attaches to both the trunk 130 of the powered decorative tree and to a non-standard two-prong fused non-polarized male electrical plug 333 which is of a different configuration than the one shown in FIGS. 1 and 2*b*.

Figure 4:
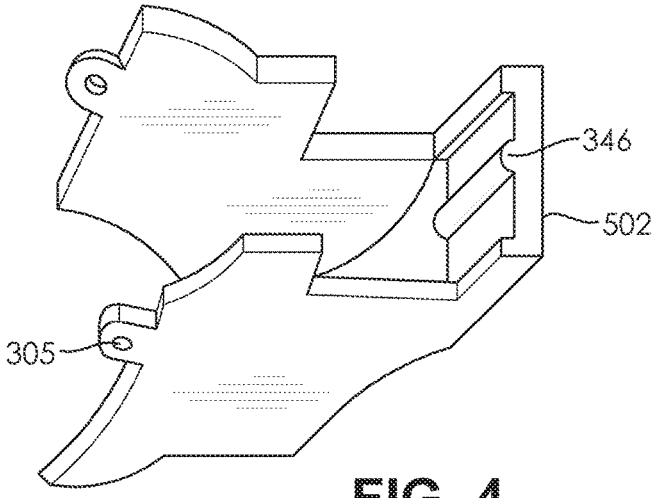
FIG. 4 shows a perspective view of the safety cover of FIG. 3, according to an embodiment of the present invention.

As best illustrated in FIG. 4, according to the presently described embodiment, the non-standard two-prong fused non-polarized male electrical plug 333 is shown to include a single mating groove 446 cut into the top and bottom lips. The power wires 534 of the non-standard two-prong fused non-polarized male electrical plug 533 separately attaches to the powered electrical tree 103 through a securing grommet 432, as shown in FIG. 5.

Figure 3:
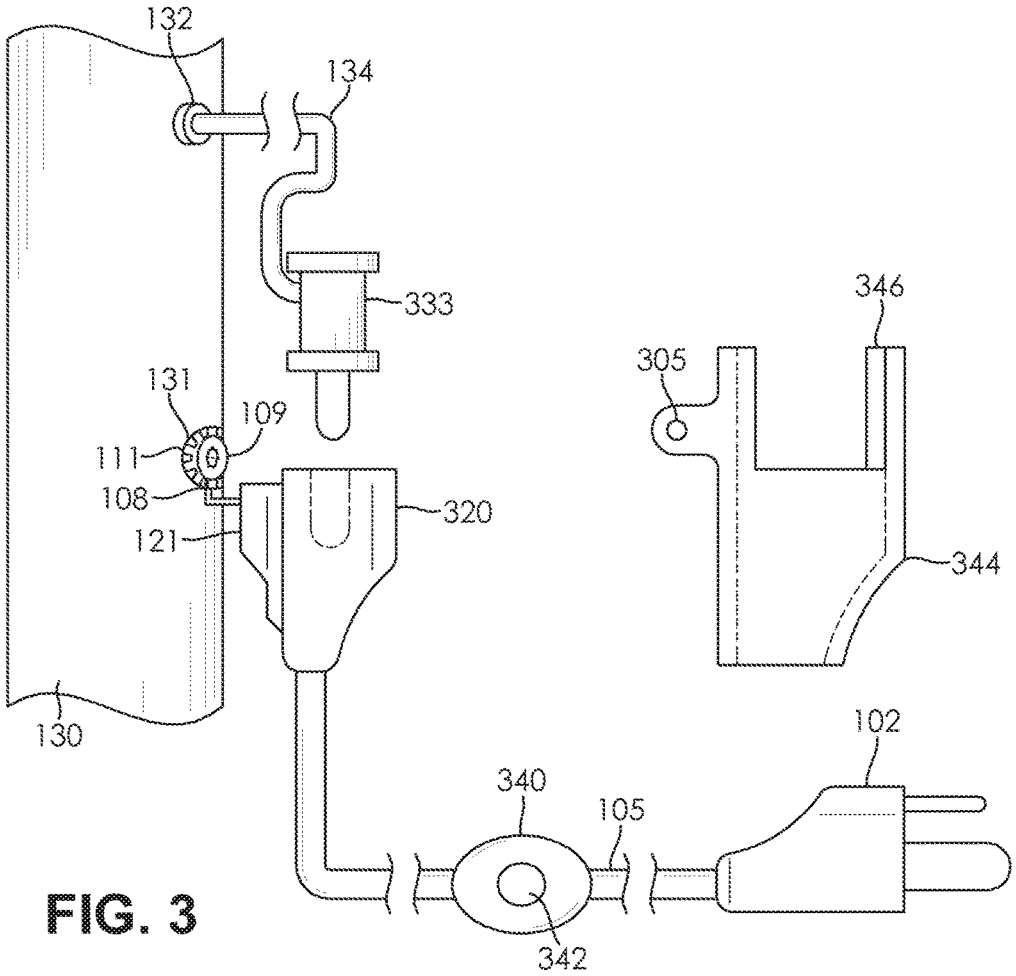
FIG. 3 shows a partially exploded view of a system for powering a decorative tree including a tree-mounted power cord with a non-standard female end which attaches to a powered decorative tree including a safety cover and an optional foot switch, according to an embodiment of the present invention.
Figure 6:
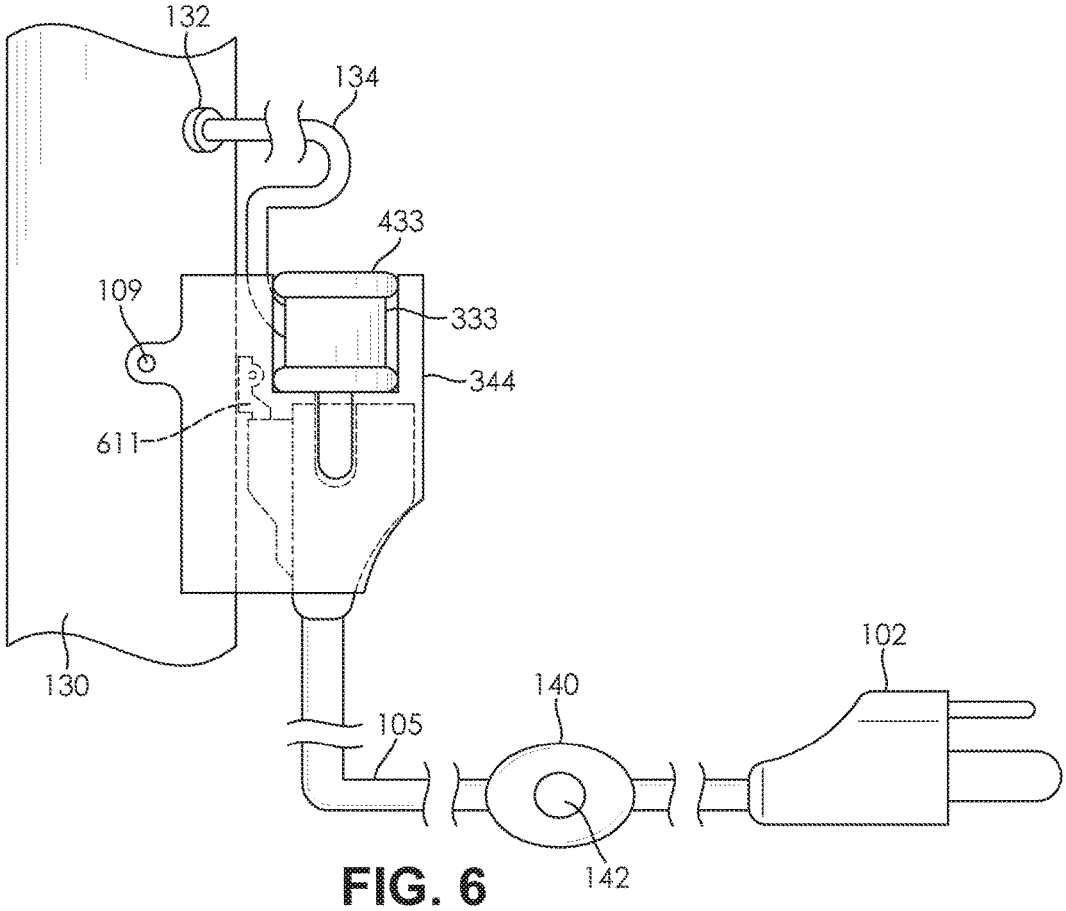
FIG. 6 shows a non-exploded view of the system of FIG. 3 for powering a decorative tree, according to an embodiment of the present invention.

As best shown in FIGS. 3 and 6, there is shown a safety cover 344 that attaches to the powered decorative tree via mounting holes 305 secured to attachment means, such as tamper proof screws 109. FIG. 6 shows the safety cover 344 fixedly attached to the trunk 130 of the powered electrical tree 103 via tamper proof screws 109. There is also shown grounding tab 611 secured to the tree trunk 130 via a tamper proof securing screw (not shown). The safety cover 344 is intended to cover both the non-standard two-prong fused non-polarized male electrical plug 533 and the standard conventional female socket 320 to prevent the inadvertent use of a standard conventional plug from being plugged into the power cord.

Figure 5:
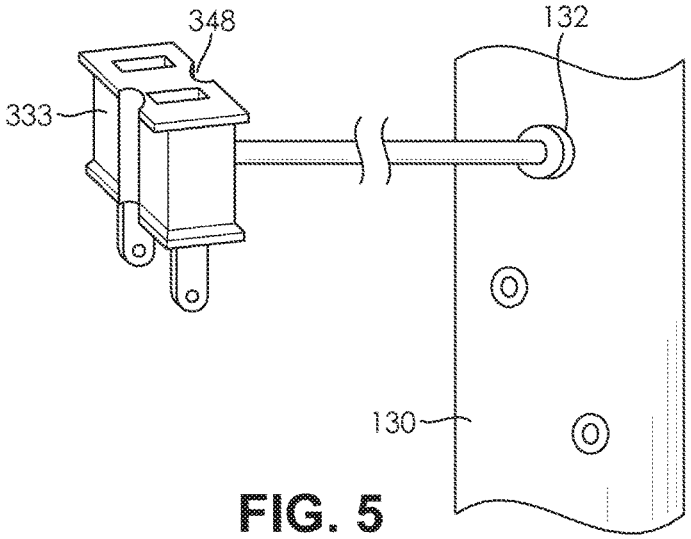
FIG. 5 shows a detailed view of the non-standard two-prong non-polarized male electrical plug of FIG. 3, according to an embodiment of the present invention.

As shown in FIG. 4, the safety cover 344 includes a single convex vertical half round 346 in an interior face of the safety cover 344 intended to mate with corresponding concave vertical half rounds 348 in the upper and lower lip of the non-polarized non-standard two-prong non-polarized male electrical plug 333, as shown in FIG. 5.

FIGS. 1, 3, 6 and 10 show an optional foot switch 140, 340, 640, 1040 in line with the power cord 115. The optional foot switch 140, 340, 640, 1040 contains a push-button toggle switch 142, 342, 642, 1042 which controls power to the decorative lighted Christmas tree. The optional foot switch 140, 340, 640, 1040 allows for controlling the lighting of the tree. In other embodiments, the control of the lighting of the tree may be controlled by one or more control elements, such as a switch, a selector knob, an indicator panel, or any other human interface device (HID) or any combination thereof. One of ordinary skill in the art would appreciate that there are numerous types of control elements that could be utilized with embodiments of the present invention, and embodiments of the present invention are contemplated for use with any type of control element. According to one embodiment of the present invention, the foot switch may include electronics which convert the high voltage AC to low voltage DC and pass the ground connection through to the non-standard female socket 420 to allow for proper grounding even when high voltage AC is not used to run the lights on the decorative lighted Christmas tree.

Figure 7:
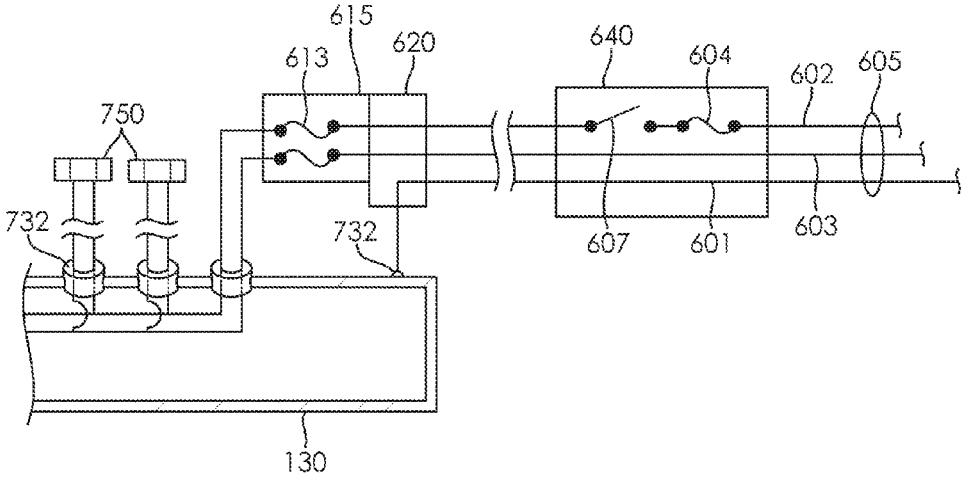
FIG. 7 shows a schematic diagram of a system for grounding a powered decorative tree according to an embodiment illustrated in FIGS. 1-6 of the present invention.

According to another embodiment of the present invention, FIG. 7 shows a schematic diagram the safety grounded decorative lighted Christmas tree. The 3-prong safety grounded plug 115 sends electrical conductors through a single pole switch 607. In one embodiment this switch is the foot switch 120 shown in FIGS. 1, 3 and 6. An electrical connector 732 is then grounded to the conductive trunk 130, creating a ground connection from the conductive trunk 130 to the ground wire 601 through an attachment means, such as a screw. The hot wire 602, and neutral wire 603 pass through the electrical connector 420 to a corresponding connector 615 that houses two fuses 613. Alternatively the fuses 613 can be housed in the electrical connector 420, or elsewhere on the tree. The hot wire 602 and neutral wire 603 then pass into the trunk 430 through a securing grommet 732 to route power throughout the inside of the trunk. Side connectors 750 outside the trunk are connected to the hot 706 and neutral 707 wires that pass through securing grommets 732 from inside the tree trunk 130 to outside the tree trunk 130. The side electrical connectors 750 may be as simple as a wire, electrically connected to the wires inside the tree trunk 130, and merely passing through a hole (not shown) in the trunk 730 to the lights on the tree, or it may be a complex detachable multi-conductor connector as depicted in this application's parent application, U.S. patent application Ser. No. 14/317,291, entitled "Safety Grounded Tree" filed Jun. 27, 2014. One of ordinary skill in the art would appreciate that there are numerous types of side electrical connector that could be utilized with embodiments of the present invention, and embodiments of the present invention are contemplated for use with any appropriate type of side electrical connector.

Figure 8:
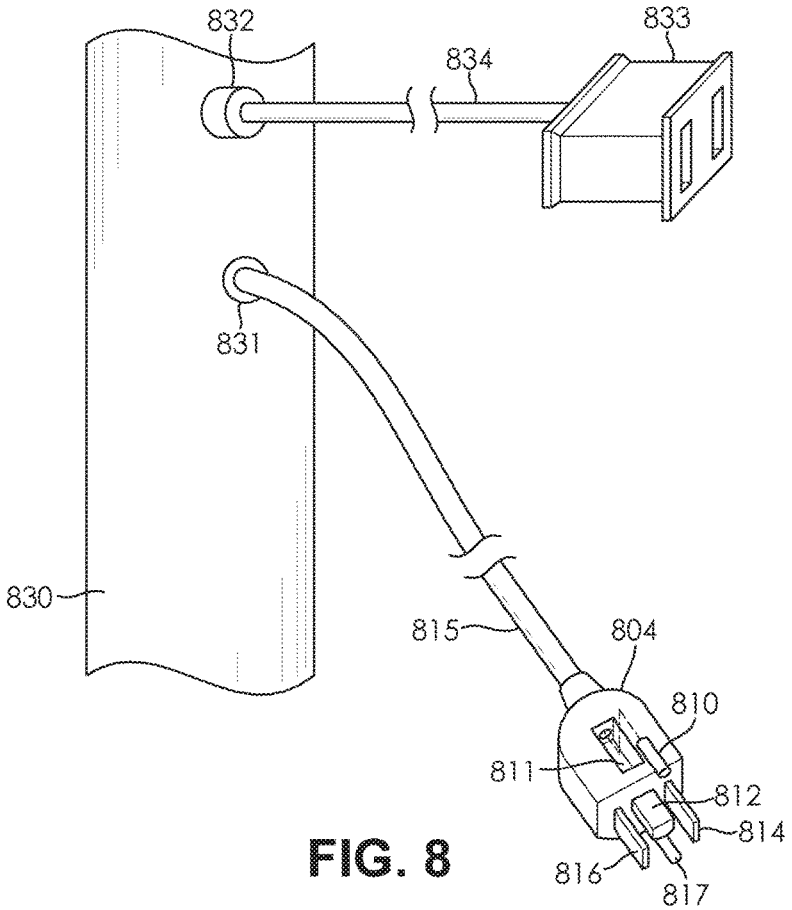
FIG. 8 shows a system for powering a decorative tree including a tree-mounted power cord with a non-standard fused three-prong polarized male electrical plug which attaches to and grounds the powered decorative tree, according to an embodiment of the present invention.

According to an embodiment of the present invention, FIG. 8 shows a perspective view of a power cord 815 with a fused 3-prong safety grounded plug 804 on the male end. The fused 3-prong safety grounded plug 804 is shown to include a live (hot) blade 816 in electrical communication with the first end of a first electrical wire (not shown) that enters the conductive trunk 930 through the securing grommet 931, a neutral blade 814 in electrical communication with the first end of a second electrical wire (not shown) through the securing grommet 831, and a ground pin 817 in electrical communication with the first end of a third electrical wire (not shown) through the securing grommet 931.

According to an embodiment of the present invention, the primary difference in the fused 3-prong safety grounded plug 804 of FIG. 8 is the access panel 811 which reveals fuse 810 when in an open position. The access panel 811 is of a generally rectangular shape and includes and access door (not shown) that is controlled by compressible engagement/disengagement means 812 (e.g., a plunger) on the plug 804 for releasably securing the fuse 810 from the recess 811 when the electrical plug 804 is disconnected from an outlet.

Figure 9:
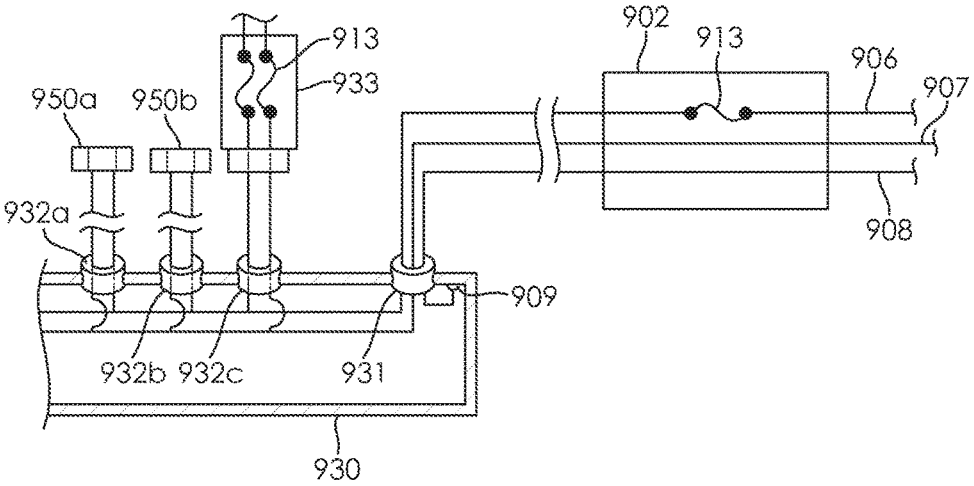
FIG. 9 shows a schematic diagram of a system for grounding a powered decorative tree according to the embodiment illustrated in FIG. 9 of the present invention.
Figure 10:
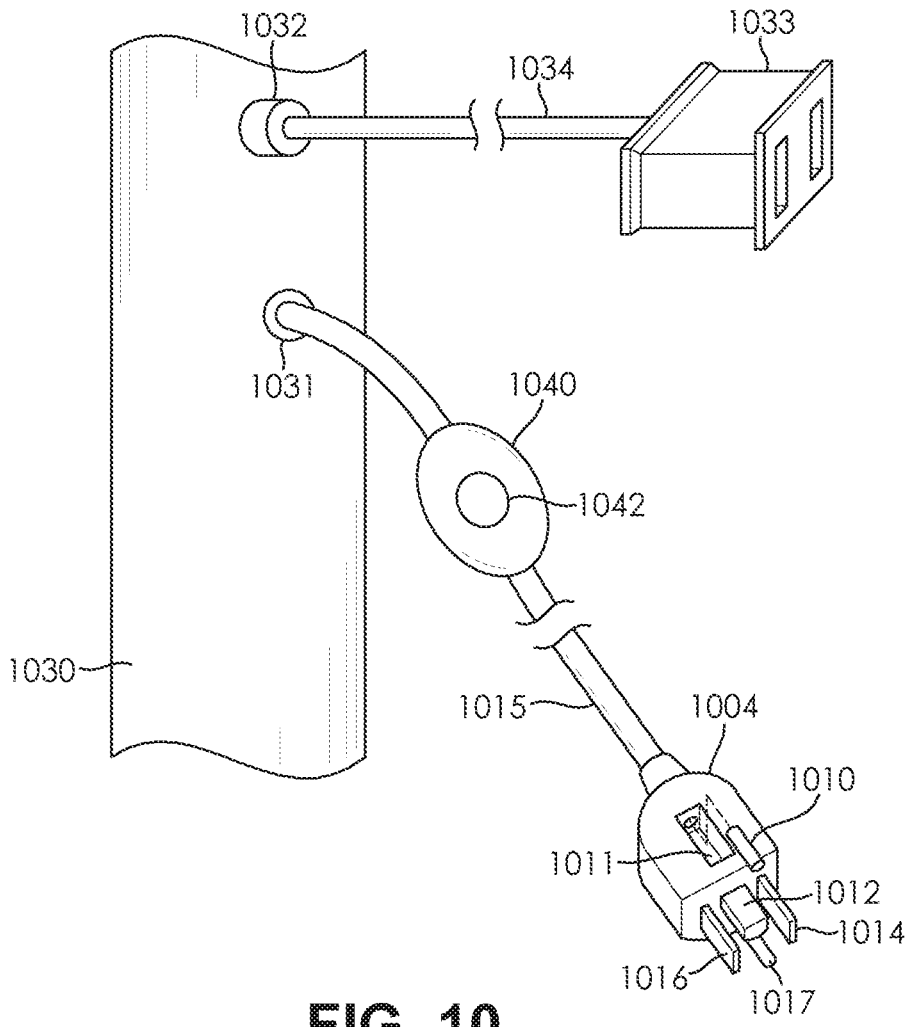
FIG. 10 shows a non-exploded view of a system for powering a decorative tree, according to an embodiment of the present invention.

According to another embodiment of the present invention, FIG. 9 shows a schematic diagram the safety grounded decorative lighted Christmas tree. The 3-prong safety grounded plug 804 of FIG. 8 sends electrical conductors (hot wire 906, neutral wire 907, and ground wire 908) through a 3-wire male plug 902 that is singly fused 913 to hot wire 906. The three electrical conductors 906, 907, 908 then enter the conductive trunk 930 through securing grommet 932*d* to route power throughout the inside of the conductive trunk 930. After passing through securing grommet 931, the ground wire 908 is grounded to the electrically conductive wall of the conductive trunk 930 at a ground connection point 909, creating a ground connection from the conductive trunk 930 to the ground wire 908. In one embodiment, ground connection point 909 is a screw. The hot wire 906, and neutral wire 907 then pass into the conductive trunk 930 through securing grommets 932*a*, 932*b* and 932*c* to route power from inside the conductive trunk 930 to female sockets 850*a*, 850*b*, located outside of the conductive trunk 930 and male plug 933, which is double fused and which is also located outside of the conductive trunk 930 as shown. The male plug 933 is preferably a standard NEMA 1 two-prong non-polarized plug. The female sockets 950*a*, 950*b* may be polarized or non-polarized. Both polarized and non-polarized sockets are configured to accept a standard NEMA 1 two-prong non-polarized plug. The hot wire and neutral wire leaving the double fused male connector 833 connect to one or multiple strings of light for lighting the tree.

One or ordinary skill in the art would recognize that wires are not necessary, and any conductor can be used, including, but not limited to, printed circuits, conductive paints, conductive liquids, or ionized gases. Embodiments of the present invention may incorporate one or more of these conductors in lieu of or in conjunction with the wires.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. An electrical power cord having improved safety features, the electrical power cord comprising:

a fused electrical plug at a first distal end, comprising:

a body portion surrounding respective first ends of a first, a second and a third electrical wire, the body portion further comprising a fuse holder embedded within an upper region of the body portion, and a fuse adapted to be releasably secured within the fuse holder via releasable securing means, wherein the releasable securing means comprises a compressible latch mechanism attached to an access door of said fuse holder, wherein said access door is maintained in a closed position when prongs of the fused electrical plug are inserted into a wall socket rendering the fuse inaccessible, and wherein said access door is maintained in an open position by removing the fused electrical plug from said wall socket, a live blade in electrical communication with the first end of the first electrical wire, a neutral blade in electrical communication with the first end of the second electrical wire, a ground pin receptacle in electrical communication with the first end of the third electrical wire, wherein the body portion surrounds and maintains the live blade, neutral blade, and ground pin receptacle in spaced apart orientation corresponding to sockets on an electrical outlet, and a cable coupled to the fused electrical plug, the cable comprising: said first, second and third electrical wires, wherein the first electrical wire is configured to carry current to a load device, the second electrical wire is configured to return current from the load device, and the third electrical wire is configured to carry current to a ground connection.

2. The electrical power cord of claim 1, further comprising a foot switch configured to toggle on and off an electrical signal provided to a second distal end of the electrical power cord.

3. The electrical power cord of claim 1, wherein the first, second and third electrical wires are passed into a conductive trunk of a lighted artificial tree via one or more securing grommets to route power from inside the conductive trunk to at least one male plug and at least two female sockets located outside the conductive trunk.

4. The electrical power cord of claim 3, wherein the at least one male plug is double fused.

5. The electrical power cord of claim 3, wherein the at least two female sockets are polarized.

6. The electrical power cord of claim 3, wherein the at least two female sockets are non-polarized.

7. A fused electrical plug having improved safety features comprising:

a body portion surrounding respective first ends of a first, a second and a third electrical wire, the body portion further comprising a fuse holder embedded within an upper region of the body portion, and a fuse adapted to be releasably secured within the fuse holder via releasable securing means, wherein the releasable securing means comprises a compressible latch mechanism attached to an access door of said fuse holder, wherein said access door is maintained in a closed position when prongs of the fused electrical plug are inserted into a wall socket rendering the fuse inaccessible, and wherein said access door is maintained in an open position by removing the fused electrical plug from said wall socket, a live blade in electrical communication with the first end of the first electrical wire, a neutral blade in electrical communication with the first end of the second electrical wire, a ground pin receptacle in electrical communication with the first end of the third electrical wire, wherein the body portion surrounds and maintains the live blade, neutral blade, and ground pin receptacle in spaced apart orientation corresponding to sockets on an electrical outlet.

* * * * *